United States Patent [19]

Mori et al.

[11] Patent Number: 4,917,153

[45] Date of Patent: Apr. 17, 1990

[54] STANDBY WEFT YARN CUTTING PREVENTING DEVICE FOR A MULTICOLOR FLUID JET LOOM

[75] Inventors: Kiyoaki Mori; Keiji Kameda, both of Ishikawa, both of Japan

[73] Assignee: Tsudakoma Corporation, Ishikawa, Japan

[21] Appl. No.: 199,007

[22] Filed: May 26, 1988

[30] Foreign Application Priority Data

May 29, 1987 [JP] Japan ..... 62-080944[U]

[51] Int. Cl.[4] ..... D03D 47/34

[52] U.S. Cl. ..... 139/435.1; 139/450

[58] Field of Search ..... 139/429, 435, 452, 450

[56] References Cited

U.S. PATENT DOCUMENTS 4,503,891 3/1985 Novak et al. ..... 139/435

FOREIGN PATENT DOCUMENTS 51-5570 2/1976 Japan .

6668 1/1978 Japan ..... 139/435

59-44419 10/1984 Japan .

19836 1/1986 Japan ..... 139/435

*Primary Examiner*—Henry S. Jaudon

*Attorney, Agent, or Firm*—Wenderoth, Lind & Ponack

[57] ABSTRACT

A standby weft yarn cutting preventing device is provided for a multicolor fluid jet loom, such as a multicolor air jet loom. In cutting a picked weft yarn among a plurality of weft yarns with the cutter of the loom, the standby weft yarn cutting preventing device drives away the free ends of the rest of the weft yarns from the operating zone of the cutter to prevent the free ends of the weft yarns on standby from being cut together with the picked weft yarn.

5 Claims, 1 Drawing Sheet

STANDBY WEFT YARN CUTTING PREVENTING DEVICE FOR A MULTICOLOR FLUID JET LOOM

BACKGROUND OF THE INVENTION

1. Field of the Invention:

The present invention relates to a multicolor fluid jet loom which in operation carries out a cutting blow, and more particularly, to a device for preventing the cutting of a weft yarn which need not be cut on such a multicolor fluid jet loom.

2. Description of the Prior Art:

In a multicolor fluid jet loom, a plurality of weft yarns are picked sequentially in a predetermined order, and the picked weft yarn is cut with a cutter provided on the picking side of the multicolor fluid jet loom. While the picked weft yarn is cut with the cutter, the free ends of the rest of the weft yarns, namely, the standby weft yarns, are extending outside of their corresponding picking nozzles. In case the free end of the standby weft yarn nears the picked weft yarn, the cutter erroneously cuts the free end of the stanby weft yarn. As a result, the free end of the thus cut standby weft yarn is blown towards a shed of a warp yarn by a cutting blow and inserted into a fabric.

The term "cutting blow" refers to a cutting blow system provided with multicolor fluid jet looms. The cutting blow is a small amount of fluid which is continuously jetted from a picking nozzle during the period of operation of the jet loom other than a picking period. Alternatively, a small amount of fluid may be jetted from the picking nozzle just before an/or just after a cutting operation. These small jets of fluid ensure that a picked weft yarn is extended and prevented from slipping off of or being extracted from its picking nozzle after the picked weft yarn has been cut by the cutter. Faulty cutting occurs frequently when hard yarns, such as hard twist yarns or glass yarns, are used as weft yarns. When such stiff yarns are used as weft yarns, the fluid is jetted continuously at a moderate rate from the picking nozzles to prevent the standby weft yarns from slipping off from the picking nozzles. The free end of the hard twist yarn is untwisted and extended by the jet of fluid to enter the operating zone of the cutter. When the glass yarn is used as a weft yarn, a portion of the picked glass yarn is slackened between the weft yarn storage device and the cutter used to cut the glass yarn, because the glass yarn is stiff. Then, a slack free end of a standby glass yarn is extended by the fluid being continously jetted from the picking nozzle and thereby the free end of the standby glass yarn reaches the cutting position of the cutter entailing erroneous weft yarn cutting. Accordingly, the multicolor fluid jet loom must be equipped with a standby weft yarn cutting prevention device.

Japanese Utility Model Publication No. 51-5570 discloses a weft yarn withdrawing device, which withdraws the free end of the standby weft yarn with a lever from the picked weft yarn to avoid the entanglement of the free end of the standby weft yarn with the picked weft yarn. This known weft yarn withdrawing device is capable of surely preventing erroneous weft yarn cutting. Nevertheless, the weft yarn withdrawing device is a complicated mechanism and inevitably applies an excessive tension to the weft yarn in withdrawing the weft yarn by hooking the weft yarn with the lever, often damaging the weft yarn. Thus, the weft yarn withdrawing device is not an effective solution of the problem from the viewpoint of maintaining the quality of the fabric.

SUMMARY OF THE INVENTION

Accordingly, it is an object of the present invention to provide a standby weft yarn cutting preventing device for a multicolor fluid jet loom, capable of avoiding the erroneous cutting of the free end of a standby weft yarn in cutting a picked weft yarn.

To achieve the object of the invention, the present invention provides a standby weft yarn cutting prevention device having an air current generating device which blows air in an air current in a direction other than the picking direction to positively separate the free end of the standby weft yarn from the picked weft yarn so that the free end of the standby weft yarn will not approach the operating zone of the cutter when the cutter cuts the picked weft yarn. The air current generating device is provided commonly for a plurality of picking nozzles or individually for each of a plurality of picking nozzles to apply an air current only to the standby weft yarn when the cutter cuts the picked weft yarn.

Thus, according to the present invention, erroneous cutting of the weft yarn can surely be avoided by a simple air current generating device preventing the detrimental insertion of the erroneously cut piece of the weft yarn into the fabric. Since the device of the present invention does not employ any mechanical restraining device, the standby weft yarn or yarns will never be damaged, and hence does not cause any defects in the fabric and does not deteriorate the quality thereof.

When the loom is provided with a control valve capable of controlling an air supply for a cutting blow, the standby weft yarn cutting preventing device of the present invention can be completed by simply providing the loom with the air current generating device. Therefore, the standby weft yarn cutting preventing device of the present invention can readily be incorporated into an existing loom as well as into a new loom.

The above and other objects, features and advantages of the present invention will become more apparent from the following description taken in conjunction with the accompanying drawings.

DETAILED DESCRIPTION OF THE INVENTION

The present invention is described herein below with reference to two preferred embodiments of a multicolor fluid jet loom employing a cutting blow system, wherein a small amount of fluid, i.e. a weak air current, is jetted from a picking nozzle during the period of time other than a picking period.

Figure 1:
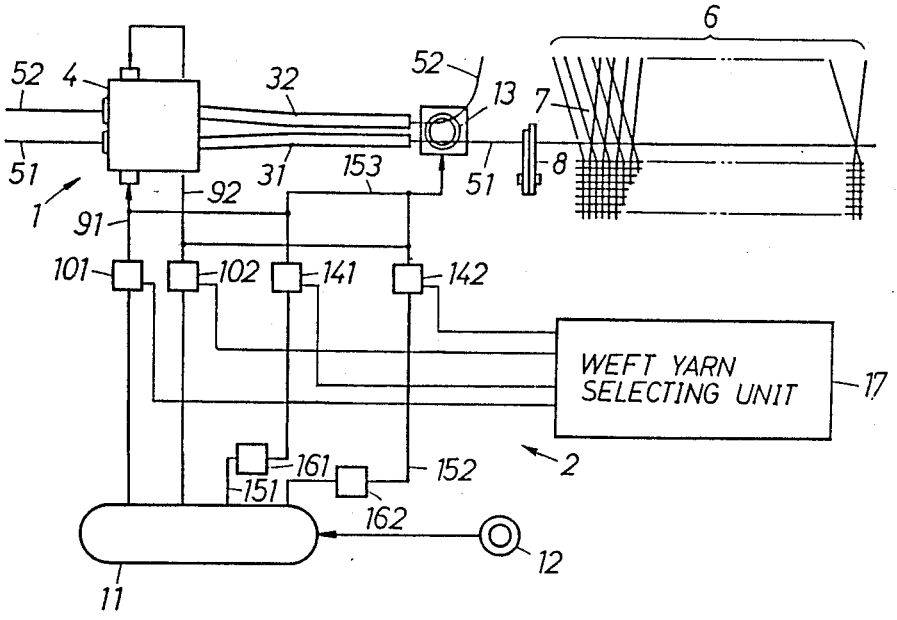
FIG. 1 is a diagrammatic illustration showing a standby weft yarn cutting preventing device for a multicolor fluid jet loom of a first embodiment according to the present invention.

First Embodiment (FIG. 1)

FIG. 1 shows a standby weft yarn cutting preventing device 2 of the present invention incorporated into a multicolor fluid jet loom 1. In this case, the multicolor fluid jet loom 1 is a two-color fluid jet loom.

The multicolor fluid jet loom 1 is provided with two picking nozzles 31 and 32 held by a nozzle holder 4. The picking nozzles 31 and 32 are operated selectively in a predetermined sequence to jet a fluid, for example, air, so that two kinds of weft yarns 51 and 52 are picked selectively in a predetermined sequence into the shed 7 of warp yarn 6. The picked weft yarns 51 and 52 are cut by a cutter 8 disposed between the picking nozzles 31 and 32 and the selvage of the fabric on the picking side. The picking nozzles 31 and 32 are connected respectively through control valves 101 and 102 by pipes 91 and 92 to a tank 11, which in turn is connected to a compressed air source 12.

The standby weft yarn cutting preventing device 2 has a single air current generating unit 13 is common for both the picking nozzles 31 and 32, and a plurality of control valves, in this embodiment two control valves 141 and 142. The air current generating unit 13 is connected to one end of a pipe 153. The other end of the pipe 153 is branched into two branches, which are connected respectively to the control valves 141 and 142. The control valves 141 and 142 are connected respectively through pressure regulating valves 161 and 162 by pipes 151 and 152 to the tank 11. The air current generating unit 13 blows compressed air in an air current in a direction other than the picking direction, for example, in a direction across the picking direction. In this embodiment, the respective outlet ports of the control valves 141 and 142 are connected also respectively to the respective inlet ports of the picking nozzles for a cutting blow, which is described in Japanese Patent Publication No. 59-44419. The control valves 141, 142 may be electromagnetic On-Off valves for controlling simultaneously the cutting blow fluid and cutting prevention fluid and controlled by the output from a weft yarn selecting unit 17. Since the selection order of the weft yarns is predetermined, the weft yarn selecting unit 17 releases the control valve 101 or 102 at the picking time on the basis of the selection order, while the weft yarn selecting unit 17 opens simultaneously the control valve 141 or 142 at the time of cutting of weft yarns 51, 52 by the cutter 8. Alternatively, control valves 141 and 142 may be mechanical On-Off valves. When mechanical on-off valves are employed as the control valves 141 and 142, the control valves 141 and 142 are operated by cams or the like in synchronism with the weaving operation of the loom. When electromagnetic on-off valves are employed as the control valves 141 and 142, the control valves 141 and 142 are operated by electric signals provided by the weft yarn selecting unit 17. The pressure regulating valves 161 and 162 regulate the pressure of air supplied to the air current generating unit 13 and air supplied to the picking nozzles 31 and 32 for the cutting blow below the pressure of air supplied to the picking nozzles 31 and 32 for picking. Regulating valves 161, 162 may be manually preset prior to operation to regulate the air pressure.

The multicolor fluid jet loom 1 opens the control valves 101 and 102 selectively one at a time according to a predetermined picking order to pick the weft yarns 51 and 52 selectively into the shed 7 of the warp yarns 6 respectively with the picking nozzles 31 and 32. The picked weft yarns 51 and 52 are cut by the cutter 8 disposed between the picking nozzles 31 and 32 and the selvage on the picking side.

During the operation of the cutter 8, the control valves 141 and 142 are opened selectively to operate the air current generating unit 13.

When the picking nozzle 31 is operated to pick the weft yarn 51 and the picked weft yarn 51 is cut by the cutter 8 as shown in FIG. 1, the control valve 141 is opened to supply compressed air to the air current generating unit 13 to blow the free end of the weft yarn 52 away from the operating zone of the cutter 8 by the air current generating unit 13, and to the picking nozzle 31 for the cutting blow to urge the picked weft yarn 51 in the picking direction by a small force so that the cutter 8 never cuts the free end of the weft yarn 52. Since the picked weft yarn 51 is held by the warp yarns and the picking nozzle 31 prior to the cutting operation of the cutter 8, the picked weft yarn 51 will not be blown outside the operating zone of the cutter 8 by a weak air current blown by the air current generating unit 13, and hence the cutter 8 never fails to cut the picked weft yarn 51. Accordingly, the cutter 8 cuts only the picked weft yarn 51. Since the control valve 141 is controlled so that the weft yarn 51 is exposed to an air current blown at a moderate pressure through the picking nozzle 31 also after the same has been cut, the free end of the weft yarn 51 is not pulled back and hence will not slip off the picking nozzle 31.

Figure 2:
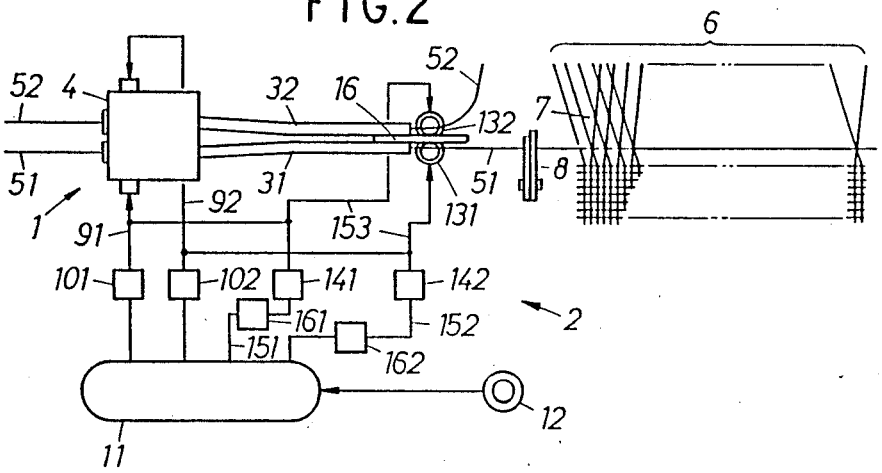
FIG. 2 is a diagrammatic illustration showing a standby weft yarn cutting preventing device for a multicolor fluid jet loom of a second embodiment according to the present invention.

Second Embodiment (FIG. 2)

FIG. 2 shows a standby weft yarn cutting preventing device 2 of a second embodiment according to the present invention, incorporated into a two-color fluid jet loom 1. The standby weft yarn cutting preventing device in the second embodiment is substantially the same in constitution as the standby weft yarn cutting preventing device in the first embodiment, except that the former is provided with two air current generating units 131 and 132 individually for the picking nozzles 31 and 32, and the control valves 141 and 142 are associated respectively with the air current generating units 131 and 132. The air current generating units 131 and 132 are actuated selectively so as to blow air only while the associated weft yarns 51 and 52 are on standby. A guide plate 16 provided between the respective extremities of the picking nozzles 31 and 32 prevents the interference of the picked weft yarn with air currents blown by the air current generating units 131 and 132 to further ensure the function of the air current generating units 131 and 132. According to the present embodiment the control valves 101, 102, 141, 142 may be controlled by the weft yarn selecting unit 17 as in the previous embodiment. However, the control valves 101, 102, 141, 142 may also be of the mechanically operated type, wherein the valves would be independently rotatably driven by a known cam mechanism in response to the picking order. Note that according to the present embodiment, the control valves 141, 142 act respectively for controlling the cutting blow of the picking nozzles 31, 32, but the mechanism for providing the cutting blow could be alternatively provided independently of the control valves 141, 142.

The air current generating units 13, 131 an 132 may be air blowers or negative pressure generating units which generate a negative pressure by the agency of jet of compressed air on the principle of a vaporizer.

Although the invention has been described in its preferred form with a certain degree of particularity, it is to be understood that many variations and changes are possible in the invention without departing from the scope thereof.

What is claimed is:

1. In a multicolor fluid jet loom having a plurality of picking nozzles for picking weft yarns and delivering in a picking direction a picked weft yarn to the selvage of a fabric being woven on the loom and a cutter operable for cutting a picked weft yarn, a standby weft yarn cutting preventing device, said standby weft yarn cutting preventing device comprising:

air current generating means disposed adjacent distal ends of the picking nozzles generating an air current for blowing weft yarns other than a picked weft yarn in a direction other than the picking direction;

a compressed air source for supplying compressed air to said air current generating means; and control valve means fluidly connected to said air current generating means and said compressed air source for supplying compressed air to said air current generating means only when the cutter is operated to cut a picked weft yarn.

2. The standby weft yarn cutting preventing device as set forth in claim 1, wherein:

a plurality of said air current generating means are provided, corresponding in number and position to the plurality of picking nozzles; and said control valve means comprises a plurality of control valves corresponding in number to said plurality of air current generating means, each said control valve corresponding to a respective said air current generating means, and each said control valve supplying compressed air to its respective air current generating means when a respective associated picking nozzle is in a standby condition.

3. The standby weft yarn cutting preventing device as set forth in claim 1, wherein:

each said control valve has means for fluidly connecting said control valve to a respective picking nozzle for providing a cutting blow to the picking nozzle.

4. In a multicolor fluid jet loom having a plurality of picking nozzles for picking weft yarns and delivering a picked weft yarn in a picking direction to the selvage of a fabric being woven on the loom and a cutter operable for cutting a picked weft yarn, a standby weft yarn cutting preventing device, said standby weft yarn cutting preventing device comprising:

at least one nozzle disposed adjacent distal ends of the picking nozzles for blowing weft yarns, other than a picked weft yarn, in a direction other than a picking direction;

a compressed air source for supplying compressed air to said at least one air nozzle;

means for fluidly connecting said compressed air source to said at least one air nozzle, said means for fluidly connecting comprising a plurality of control valves; and means for operating said plurality of control valves to supply said at least one air nozzle with air from said compressed air source when said cutter is operated to cut a picked weft yarn, said plurality of control valves corresponding in number to the plurality of picking nozzles.

5. The standby weft yarn cutting preventing device of claim 4, and further comprising:

means for fluidly connecting each said control valve to a respective picking nozzle for providing a cutting blow to the picking nozzle.

* * * * *